US011536537B2

(12) United States Patent
Hanley et al.

(10) Patent No.: US 11,536,537 B2
(45) Date of Patent: Dec. 27, 2022

(54) ARCHERY SCOPE AND ACCESSORIES

(71) Applicants: Kolby John Hanley, Snellville, GA (US); George Dewey Ryals, IV, Snellville, GA (US); Zachary Bruce Harris, Loganville, GA (US)

(72) Inventors: Kolby John Hanley, Snellville, GA (US); George Dewey Ryals, IV, Snellville, GA (US); Zachary Bruce Harris, Loganville, GA (US)

(73) Assignee: Ultraview Archery LLC, Snellville, GA (US)

( * ) Notice: Subject to any disclaimer, the term of this patent is extended or adjusted under 35 U.S.C. 154(b) by 966 days.

(21) Appl. No.: 16/294,564

(22) Filed: Mar. 6, 2019

(65) Prior Publication Data

US 2019/0277601 A1 Sep. 12, 2019

Related U.S. Application Data

(60) Provisional application No. 62/639,792, filed on Mar. 7, 2018.

(51) Int. Cl.

| | |
|---|---|
| ***F41G 1/34*** | (2006.01) |
| ***F41G 11/00*** | (2006.01) |
| ***F41G 1/467*** | (2006.01) |
| ***F41G 1/54*** | (2006.01) |

(52) U.S. Cl.

CPC ..... *F41G 1/345* (2013.01); *F41G 1/467* (2013.01); *F41G 1/545* (2013.01); *F41G 11/001* (2013.01)

(58) Field of Classification Search

CPC ..... F41G 1/345; F41G 1/467; F41G 1/545; F41G 11/001

See application file for complete search history.

(56) References Cited

U.S. PATENT DOCUMENTS

| | | | | |
|---|---|---|---|---|
| 6,550,418 | B2 * | 4/2003 | Williamson | G01P 13/02 73/170.04 |
| 7,089,698 | B2 | 8/2006 | Afshari | |
| 8,122,874 | B2 * | 2/2012 | LoRocco | F41B 5/066 124/25.7 |
| 8,398,256 | B2 * | 3/2013 | Fridley | F41G 1/35 362/110 |
| 8,939,140 | B2 * | 1/2015 | Mancini | F16M 13/022 124/89 |
| 9,310,165 | B2 * | 4/2016 | Bell | F41G 3/08 |

(Continued)

*Primary Examiner* — Yaritza Guadalupe-Mccall

(74) *Attorney, Agent, or Firm* — Troutman Pepper Hamilton Sanders LLP; Ryan A. Schneider; Christopher C. Close, Jr.

(57) ABSTRACT

An optical sighting assembly including an improved scope body and detachable accessories is presented. The accessories can be magnetically attachable to the scope body and can include a lens cartridge, a light pack, power pack and/or an alignment ring. The lens cartridge can be keyed to be installed at a predetermined rotational orientation, and the lens cartridge can hold a small diameter lens. Lenses can include a fluorescent aiming point that can fluoresce due to ambient light and/or when illuminated by an LED. The light pack can include the LED, a power source, and a control interface for adjusting light output. Alternatively, the LED can be integrated into the scope body, and a battery pack can include a power source and a control interface for the LED.

19 Claims, 11 Drawing Sheets

(56) References Cited

U.S. PATENT DOCUMENTS

| | | | | |
|---|---|---|---|---|
| 9,310,173 | B2 * | 4/2016 | Bay | F42B 12/365 |
| 9,429,393 | B2 | 8/2016 | Graziano et al. | |
| 9,644,921 | B1 | 5/2017 | LoRocco et al. | |
| 10,175,023 | B2 * | 1/2019 | Yehle | F41B 5/123 |
| 10,488,156 | B2 * | 11/2019 | York | G02B 27/34 |
| 11,054,217 | B2 * | 7/2021 | Fruechtel | F41G 1/44 |
| 2002/0139290 | A1 * | 10/2002 | Williamson | G01P 13/02 116/200 |
| 2010/0024793 | A1 * | 2/2010 | LoRocco | F41B 5/066 124/88 |
| 2011/0235346 | A1 * | 9/2011 | Fridley | F41G 11/001 42/99 |
| 2012/0085331 | A1 * | 4/2012 | Lang | F41B 5/10 124/88 |
| 2013/0000622 | A1 * | 1/2013 | McCauley | F41G 11/001 124/88 |
| 2016/0069644 | A1 * | 3/2016 | Bell | F41G 1/38 89/204 |
| 2017/0082400 | A1 * | 3/2017 | York | F41G 1/44 |
| 2019/0277601 | A1 * | 9/2019 | Hanley | F41G 11/001 |
| 2019/0376766 | A1 * | 12/2019 | Fruechtel | F41G 1/44 |
| 2020/0232762 | A1 * | 7/2020 | Hamilton | F41A 9/62 |
| 2020/0278179 | A1 * | 9/2020 | Ding | F41G 1/545 |
| 2021/0348886 | A1 * | 11/2021 | Havens | F41G 3/165 |

* cited by examiner

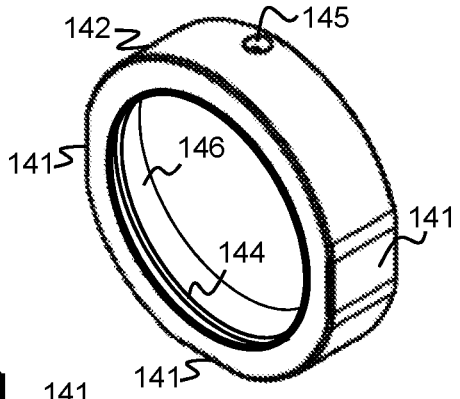
Figure 7A
Figure 7B
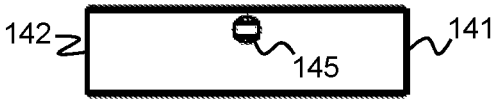
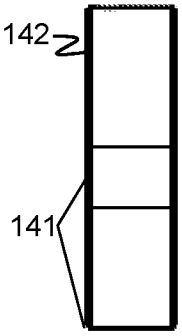
Figure 7E
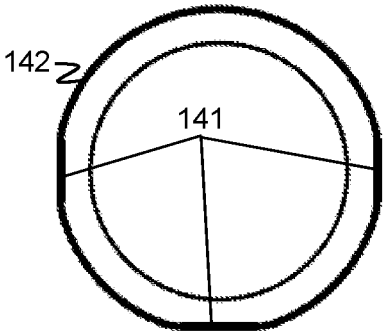
Figure 7F
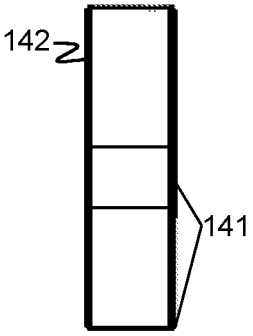
Figure 7C
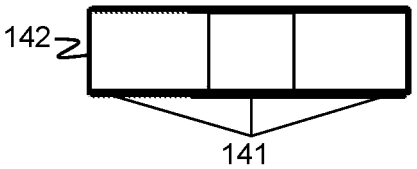
Figure 7D

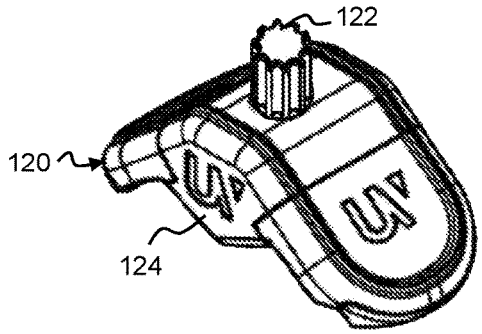
Figure 8A
Figure 8B
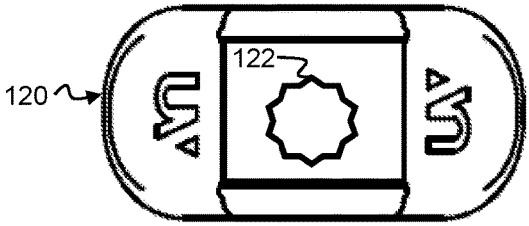
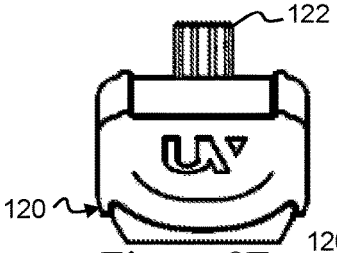
Figure 8E
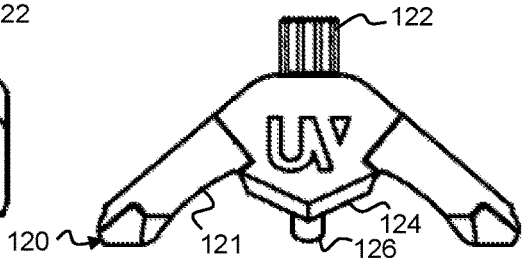
Figure 8F
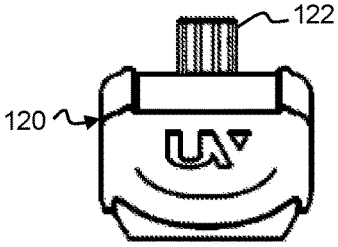
Figure 8C
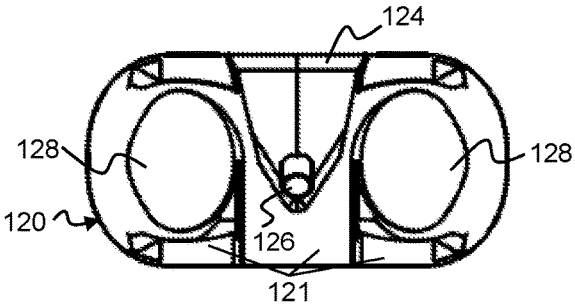
Figure 8D

ARCHERY SCOPE AND ACCESSORIES

CROSS-REFERENCE TO RELATED APPLICATIONS

This Application claims priority under 35 U.S.C. § 119(e) to U.S. Provisional Patent Application No. 62/639,792, "Archery Sight with Magnetic Connectors and Integrated Light" filed Mar. 7, 2018 which is hereby incorporated by reference herein in their entireties as if fully set forth below.

BACKGROUND OF THE INVENTION

This disclosure relates generally to optical sighting devices and assemblies, and more particularly to archery scopes.

Generally, optical sighting devices can be used to view a target and can include a housing that holds a lens. Some current optical sighting devices also include an aiming point, reticle, up pin, or the like either attached to the lens or otherwise in the sight line of the optical sighting device.

In the case of scopes for bows or rifles, it can be advantageous to provide a visual contrast between an aiming point in the scope and a target down range. In low light conditions such as in large venue halls, the woods, or shooting at dusk, a high contrast aiming point can make it easier for a user to see the aiming point for more accurate aiming at the target. In the case of archery scopes, a common solution is to channel light through a fiber optic cable that is positioned in the slight line with an up pin. The up pin typically includes a thin hollow tube sized to hold the fiber optic cable and a tip positioned at the center of the sight line of the scope and/or center of the lens. In some designs the fiber optic cable is spooled around the scope to collect ambient light and direct the collected light out of the tip of the up pin at the center of the sight line and/or lens.

The spooled fiber design has disadvantages, however. To collect a sufficient amount of ambient light for most applications, long lengths of fiber are used, which is expensive. The up pin is opaque and obstructs the sight line thereby reducing aiming accuracy in some applications. Further, some ambient light conditions are dark enough that the spooled fiber design does not provide sufficient contrast at the aiming point.

Another common design is to use a battery powered LED to illuminate a fiber optic cable supported by an up pin. Although the LED design can provide sufficient contrast in very low light conditions, the LED design also has disadvantages. LEDs can have low energy wavelengths ranging from 400 nm to 750 nm and therefore long expensive lengths of optical fiber are still used in many designs. The LED requires an energy source to provide illumination, which typically is provided by a battery pack connected to the LED with wires. In the case of archery scopes, the battery pack and wires are typically secured to a sight in a somewhat ad-hoc manner with hook and loop (e.g. Velcro) straps, zip ties, and/or other strapping mechanisms. The wires that lead to the LED can become tangled and get in the way either mechanically or visually when aiming and/or shooting.

U.S. Pat. No. 9,644,921 illustrates a device that can have an external battery powered LED that can be directly installed on a scope housing. Although the directly installed design can eliminate the need for wires and ad-hoc attachment solutions, the directly installed design also has disadvantages. The LED design is installed with screws that render the device difficult to remove. Further, the aiming point is only visible when it is illuminated, so when the battery is removed, the aiming point is not visible, and the scope is not as effective as an aiming aid. In competitive archery, removing batteries is required under World Archery Rule 11.3.1. Because the aiming point is not visible when the batteries are removed, this design is not viable for competitive archery applications. The directly installed design requires the use of proprietary lenses and does not give the user an option of using whatever lens they so choose, which is another disadvantage. The directly installed design also has sight line obstructions, which is another disadvantage.

Some optical sighting devices can be assembled with detachable accessories such as a lens retainer, a color (alignment) ring, etc. Such accessories are typically attached with threads that screw into a scope housing or with set screws. A disadvantage of threaded or screwed accessories is that attaching and detaching with screws can be time consuming. For threaded lens retainers in particular, it can take an undesirable amount of time to detach, clean, and reattach a lens. Further, there is not an easy reliable way to ensure that the lens, once reattached has the same rotational alignment as before it was removed, which can change the sightline view and make aiming less accurate if the lens is not perfectly symmetrical.

BRIEF SUMMARY OF THE INVENTION

It is an object of the present invention to meet some or all of the above stated needs. Embodied systems, devices, and methods disclosed herein can generally include an improved scope housing and detachable accessories and methods for making and using the same.

In some embodiments, the optical sighting assembly can include a scope body and one or more accessories magnetically attachable to the scope body including a lens cartridge, a light pack, and an alignment ring (color ring). The lens cartridge can have an annular housing sized to hold a lens and sized to slide into a bore of the scope body. The lens cartridge can hold a lens having an integrated or attached fluorescent aiming point. The housing of the lens cartridge can have a keyed outer surface so that it can be reliably installed in the scope body in a predetermined orientation. The housing of the lens cartridge can be secured within the scope body with a set screw and/or with magnets. The light pack can include a light emitting diode (LED), a power source, and a control interface. When the light pack is attached to the scope body, the LED can illuminate an aiming point on a lens in the bore of the scope body, the power source can power the LED, and the control interface can be manipulated by a user to adjust light output from the LED. The alignment ring can include a colored or high contrast surface that can be positioned in the sightline of the user and a magnetic extension that can form a magnetic attachment to the scope body.

In some embodiments, an optical sighting assembly can include an aiming point, and the aiming point can be visible absent illumination from an LED, optical fiber, or other lighting accessory. The aiming point can be fluorescent, and it can be affixed to or integrated into a lens to provide an obstruction free sight path. The fluorescent aiming point can be illuminated by an ultraviolet, battery powered LED. The LED can be integrated into a scope housing. The optical sighting assembly can include a battery pack for powering the LED that can be attach to the scope housing via magnets, thereby facilitating quick and easy attachment and detachment of the battery pack. The optical sighting assembly can include an archery scope, and the magnetic battery pack can be detached from the housing to configure the archery scope to be compliant with World Archery rule 11.3.1.

An example optical sighting assembly can include an optical scope body with a sighting bore and a magnetically attachable accessory. The assembly can further include a lens attached to the scope body, a fluorescent aiming point attached to the lens, and a light source attached to the scope body and positioned to illumination the aiming point through air or other non-solid medium. The light source can illuminate the aiming point without obstructing a sight line in the sighting bore. The accessory can include an energy source to provide energy to the light source.

The accessory can include a housing shaped to house an energy source such as a lithium coin cell battery, a rechargeable battery, or a capacitor and a user interface that can be manipulated to adjust electrical current supplied by the energy source.

The scope body can include the light source and an electrically conductive coated magnet. The housing of the accessory can include another electrically conductive coated magnet, and current can be conducted from the energy source, through the coating on the magnets, and to the light source when the magnets are mated. Alternatively, both the light source and the energy source can be integrated into the accessory, the light source can be connected to the energy source by via electrical connections within the accessory, and the light source can be positioned to illuminate the aiming point when the accessory is magnetically attached to the scope body.

In addition to, or in stead of housing an energy source, the accessory can include a lens cartridge and/or an alignment ring. A lens cartridge accessory can have a keyed surface to mate with the scope body at a predetermined orientation and a lens receptacle to hold a lens. An alignment ring accessory can have magnetic extensions that can be placed within the bore of the scope body to form a magnetic attachment to the scope body.

Another example optical sighting assembly can include an optical scope body with a sighting bore and a lens cartridge that can be detachably installed in the sighting bore at a predetermined rotational orientation. The lens cartridge can have a keyed surface to facilitate the predetermine rotational orientation installation and a lens receptacle for holding a lens. Lens cartridges having lens receptacles sized to hold different sized lenses can be interchangeably installed in the sighting bore, where the lens sizes in the different cartridges are different enough that the lens of one cartridge is incompatible with the other cartridge. The lens cartridge can be secured within the sighting bore with a set screw.

The assembly can further include a lens retained within the lens cartridge, a fluorescent aiming point attached to the lens, a light source positioned on the scope body to illuminate the aiming point, and an energy source providing electrical current to the light source. The light source can be positioned to illuminate the aiming point without obstructing a sight line in the sighting bore. The light source and/or the energy source can be magnetically attachable to the scope body. The assembly can further include a light pack that is magnetically attachable to the scope body. The light pack can include an LED positioned to illuminate the aiming point when the light pack is magnetically attached to the scope body and energy source to power the LED.

These and other aspects of the present disclosure are described in the Detailed Description below and the accompanying figures. Other aspects and features of embodiments of the present disclosure will become apparent to those of ordinary skill in the art upon reviewing the following description of specific, example embodiments of the present disclosure in concert with the figures. While features of the present disclosure may be discussed relative to certain embodiments and figures, all embodiments of the present disclosure can include one or more of the features discussed herein. Further, while one or more embodiments may be discussed as having certain advantageous features, one or more of such features may also be used with the various embodiments of the disclosure discussed herein. In similar fashion, while example embodiments may be discussed below as device, system, or method embodiments, it is to be understood that such example embodiments can be implemented in various devices, systems, and methods of the present disclosure.

BRIEF DESCRIPTION OF THE SEVERAL VIEWS OF THE DRAWINGS

The above and further aspects of this invention are further discussed with reference to the following description in conjunction with the accompanying drawings, in which like numerals indicate like structural elements and features in various figures. The drawings are not necessarily to scale, emphasis instead being placed upon illustrating principles of the invention. The figures depict one or more implementations of the inventive devices, by way of example only, not by way of limitation.

FIGS. 7A through 7F illustrate various views of the lens cartridge of the example cartridge and lens assembly illustrated in FIGS. 5A and 6 according to aspects of the present invention;

FIGS. 8A through 8F illustrate various views of a light pack according to aspects of the present invention;

DETAILED DESCRIPTION OF THE INVENTION

Figure 1A:
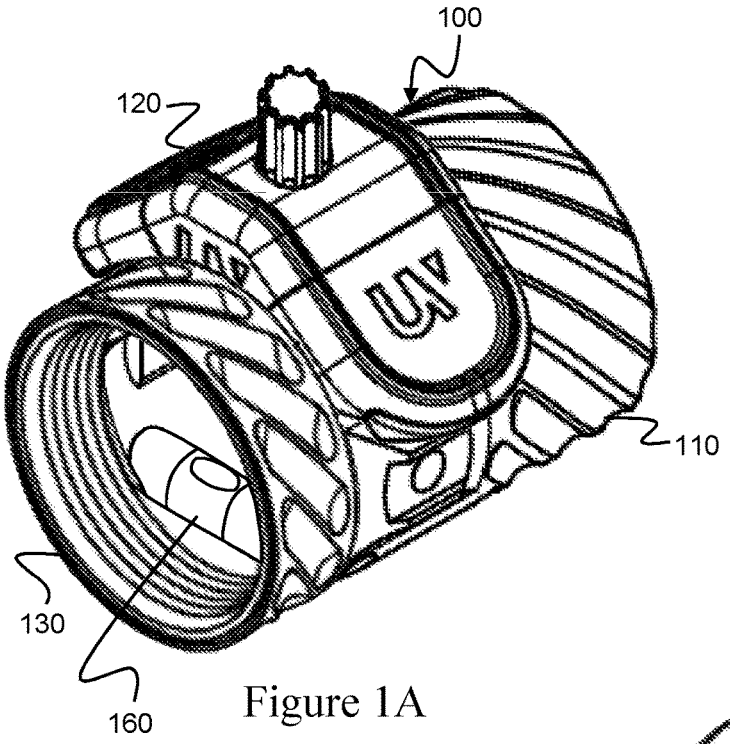
FIGS. 1A and 1B illustrate an isometric view and a front/user view of an example optical sighting assembly, respectively, according to aspects of the present invention.

The example embodiments disclosed herein illustrate devices and systems for an improved scope housing and detachable accessories. The components, steps, and materials described hereinafter as making up various elements of the disclosed technology are intended to be illustrative and not restrictive. Many suitable components, steps, and materials that would perform the same or similar functions as the components, steps, and materials described herein are intended to be embraced within the scope of the disclosed technology. Such other components, steps, and materials not described herein can include, but are not limited to, similar components or steps that are developed after development of the disclosed technology.

Referring to the figures, at a high level, FIGS. 1A through 9F illustrate an embodiment of an optical sighting assembly 100 and components thereof including a magnetic scope body 110, a magnetic light pack 120, a magnetic alignment ring 130, a keyed lens cartridge 140, and a fluorescent aiming point 152; FIGS. 10 through 13E illustrate another embodiment of an optical sighting assembly 200 and components thereof including a magnetic scope body 210, a magnetic power pack 220, and a threaded alignment ring 230. Embodiment are contemplated that include a combination or sub-combination of components from a single figure, multiple figures, alternative configurations described in relation to the figures, substitute and/or additional components known in the art, and substitute and/or additional components developed after development of this technology, and such embodiments are intended to be embraced within the scope of the disclosed technology.

Figure 1B:
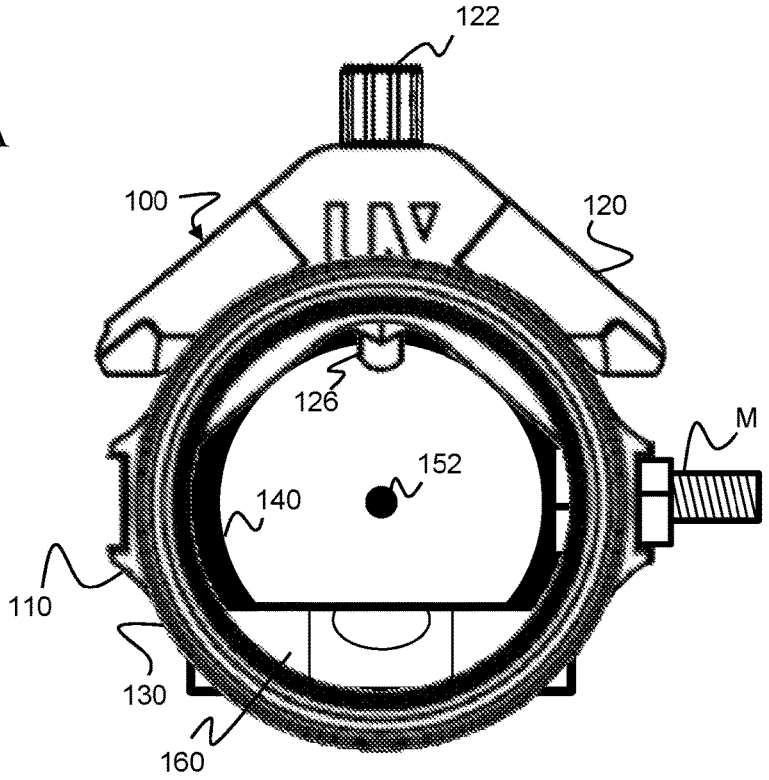

FIG. 1A illustrates an isometric view of an embodiment of an optical sighting assembly 100. FIG. 1B illustrates a front/user view of the optical sighting assembly 100 attached to a mount M. The optical sighting assembly can include a scope body 110, a light pack 120, an alignment ring 130, a cartridge and lens assembly 140 including a lens with an attached aiming point 152, and a level 160. Each accessory 120, 130, 140 can be detachably attached to the scope body 110 with magnets or other means. Accessories 120, 130, 140 can be designed so that they don't obstruct the field of view of a user while aiming with an assembled optical sighting assembly 100.

The light pack 120 can include an LED 126 or other light source, and when the light pack 120 and cartridge and lens assembly 140 are attached to the scope body 110, the LED 126 can be positioned to direct light at the aiming point 152. The aiming point 152 can be fluorescent and emit light as a result of being illuminated by the LED. The LED can emit ultraviolet light that is outside of the visible range for a user to eliminate any visible glare from light reflection from the LED off of the lens. In some applications, availability of ambient light can cause the aiming point 152 to fluoresce without being illuminated by the LED. The aiming point 152 can be tinted to further increase the visibility of the aiming point 152 absent illumination from the LED. With a fluorescent aiming point 152, there is no need to use spooled optical fiber to collect ambient light, there is no need to use optical fiber to deliver light to the aiming point 152, and there is no need for an up pin or other obstructive device to position and/or illuminate the aiming point 152. The optical sighting assembly 100 can be completely devoid of optical fiber, up pins, and other such sightline obstructions.

The light pack 120 can house an energy source for powering the LED, and the light pack can include a user interface 122 for controlling light output from the LED. The light output can be controlled to be on or off, to have a selectable brightness, and/or to have a selectable color output. The dial interface 122 illustrated in FIG. 1 can be connected to the energy source via a potentiometer such that rotating the dial 122 causes the resistance in the electrical current path between the LED and the energy source to change, thereby changing the current through the LED and the brightness of the LED. Alternatively, or additionally, the light source can include a red, green, and blue LEDs each connected to the energy source via the dial interface 122 illustrated in FIG. 1 such that rotating the dial 122 causes light output from each LED to vary, thereby varying the color output of the light source.

The energy source can be a replaceable battery (e.g. a CR2032 coin cell), a rechargeable battery, a capacitor, etc. Embodiments are contemplated wherein the light pack further includes a power port for charging a rechargeable power source and associated protection and charging circuitry. Embodiments that include circuitry for wireless inductive charging of a rechargeable capacitor or battery are contemplated. Embodiments that include circuitry for piezoelectric charging via vibration absorption of the bow are contemplated.

The user interface 122 can include one or more of a dial, a switch, a button, a slider, a wireless interface for communicating with a remote-control device, or other means for providing an input for controlling light output from the LED 118. Embodiments that include a wireless interface can include a wireless receiver or transceiver in communication with a remote control or user device via infrared transmission, radio frequency transmission, or other wireless transmission are contemplated. Embodiments are contemplated wherein a user can provide commands through an application on a mobile device, the mobile device can wirelessly transmit the commands to the wireless interface of the light pack 120, and the light output of the light pack 120 can be adjusted based on the commands.

Figure 2:
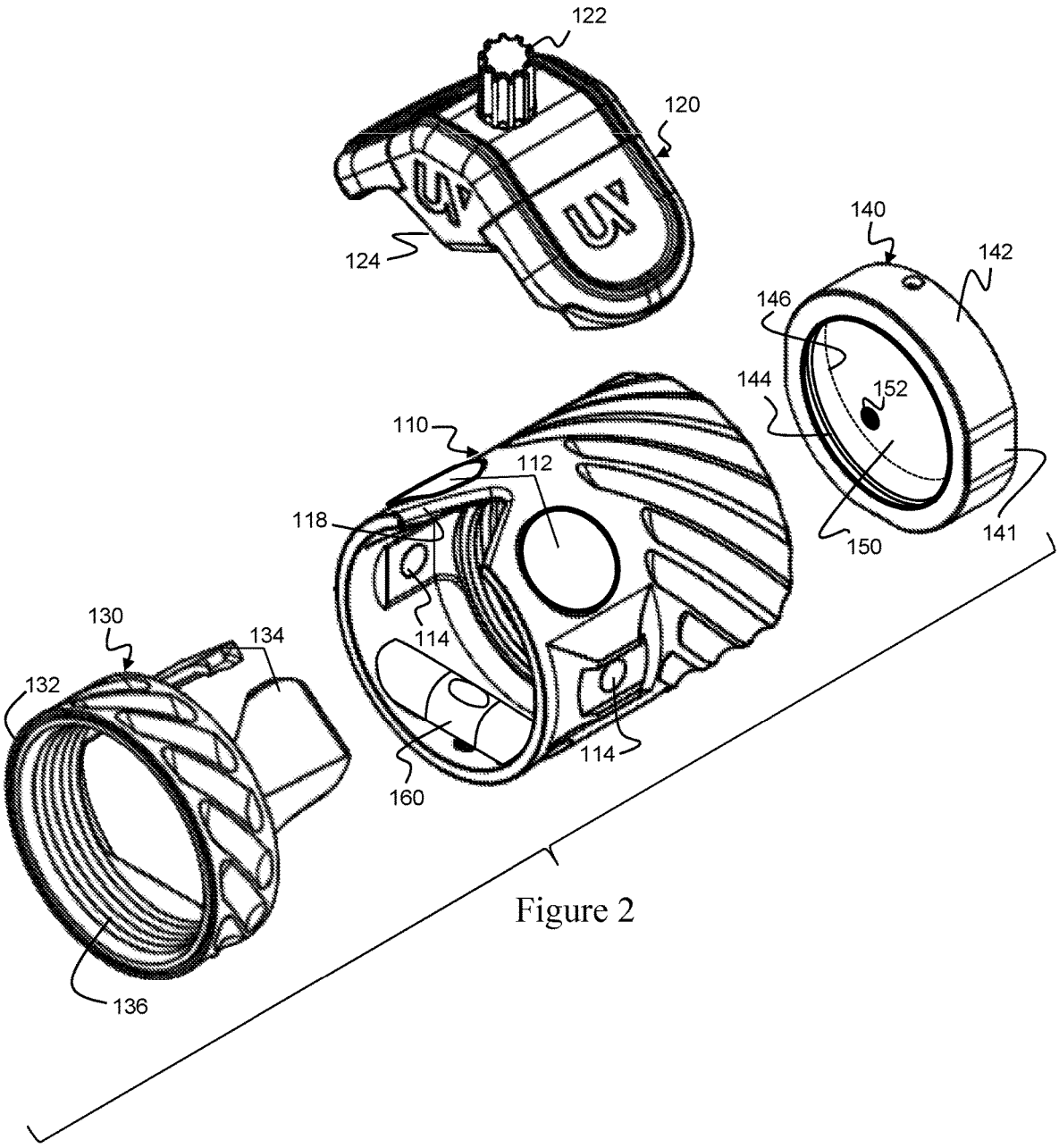
FIG. 2 illustrates an isometric exploded view of the example optical sighting assembly illustrated in FIGS. 1A and 1B according to aspects of the present invention.

FIG. 2 illustrates an isometric exploded view of the optical sighting assembly 100 illustrated in FIGS. 1A and 1B.

As illustrated, the scope body 110 can include two magnets 112 that are positioned to engage the light pack 120 on the outer surface of the scope body 110 and to engage magnetic extensions 134 of the alignment ring 130 within the bore of the scope body 110. In the illustration, the pair of magnets 112 each attract both the alignment ring 130 and the light pack 120. Alternative configurations are contemplated including using a single magnet in the scope body 110, using non-circular magnets, alternative placement of magnets on the scope body 110, using additional magnets, using separate magnets for each accessory 120, 130, integrating magnets into each accessory 120 and using magnetic metal in place of the magnets 112 in the scope body 110, etc. Some or all of the magnets can be standard, having a north pole on one side and a south pole on the other, and some or all of the magnets can be customized with north and south poles having a customizable pattern. It is contemplated that magnets having a customized pattern can facilitate a rotate-release attachment, and/or a specific rotational alignment using a single magnet.

The scope body 110 can include a notch 118 that can receive an extension 124 of the light pack 120 that houses the LED. When assembled, the extension 124 can fit within the notch 118, positioning the LED to illuminate the bore of the scope body 110. The scope body can include one or more sight mounting holes 114 for mounting the scope body 110 to a sight or other aiming device. Level 160 can be mounted in the scope body 110.

The alignment ring 130 can have a colored or otherwise high contrast surface 132 that can be positioned to be visible by a user when aiming with the optical sighting assembly 100. The alignment ring 130 can include a light refracting surface 136 to reduce glare in the sightline. The alignment ring 130 can have one or more magnetic extensions 134 for magnetically engaging the scope housing 110. The illustrated alignment ring 130 has two extensions 134 that extend within the sighting bore of the scope body 110. The magnetic extensions 134 can include a magnet and/or a metal that can be attracted by a magnetic force.

The cartridge and lens assembly 140 can include a cartridge outer housing 142, an O-ring 144, a cartridge inner housing 146, a lens 150, and an aiming point 152. The outer housing 146 can be keyed with one or more notches 141, so that the cartridge and lens assembly 140 can be installed in the bore of the scope body 110 at a predetermined rotational orientation. As illustrated, the cartridge and lens assembly 140 can be secured within the scope housing 110 with a set screw. It is contemplated that the cartridge and lens assembly 140 can alternatively or additionally be secured within the scope housing 110 with one or more magnets.

Figure 3B:
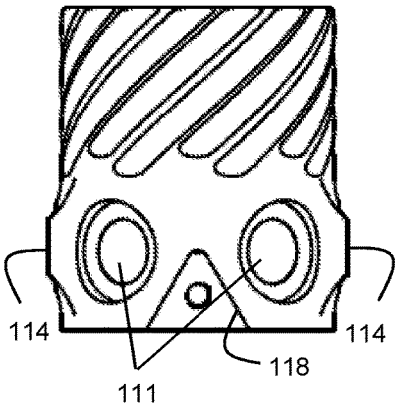
FIGS. 3A through 3F illustrate various views of an example optical scope body according to aspects of the present invention.
Figure 3A:
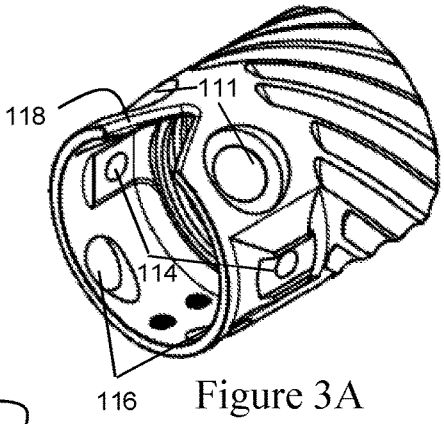
Figure 3E:
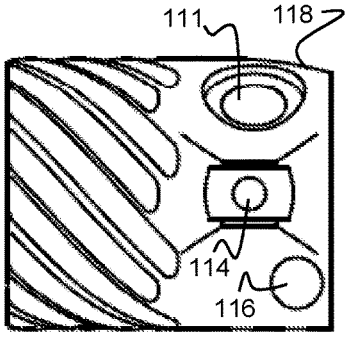
Figure 3F:
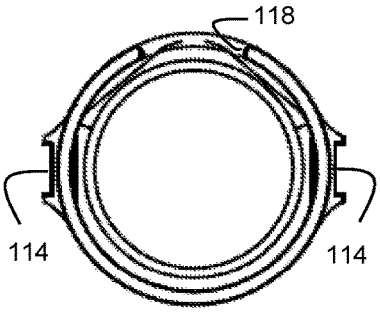
Figure 3C:
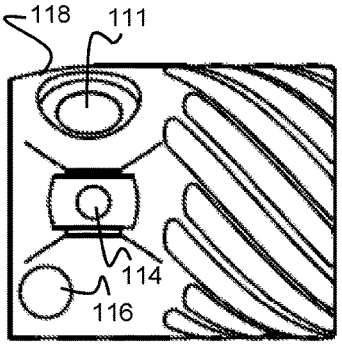
Figure 3D:
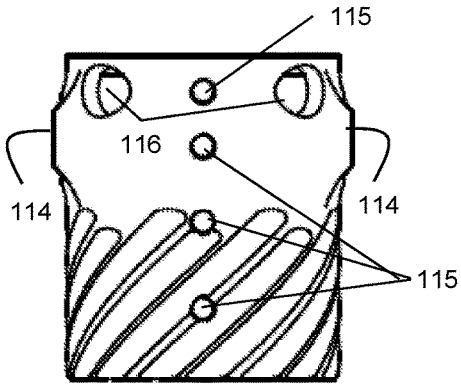

FIGS. 3A through 3F illustrate various views of the optical scope body described in relation to FIGS. 1A, 1B, and 2. FIG. 3A is an isometric view, FIG. 3B is a top view, FIG. 3C is a right side view, FIG. 3D is a bottom side view, FIG. 3E is a left side view, and FIG. 3F is a front or aiming user view. The scope body 110 is illustrated in FIGS. 3A-F without the magnets 112 and the level 160 illustrated in FIG. 2 installed, so that receptacles 111 for the magnets 112 and level mounting holes 116 are visible. Set screw holes 115 can be positioned on the bottom of the optical scope body 110 as illustrated in FIG. 3D. Set screws (e.g. 8-32 set screws) can be installed in the set screw holes 115 to secure the cartridge and lens assembly 140, level 160, or other accessory not shown such as a sun shade or up pin within the scope body 110.

Figure 4A:
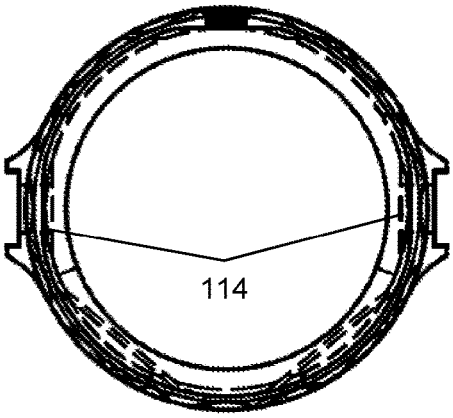
FIGS. 4A through 4D illustrate additional views of the example optical scope body illustrated in FIGS. 3A through 3F according to aspects of the present invention.
Figure 4B:
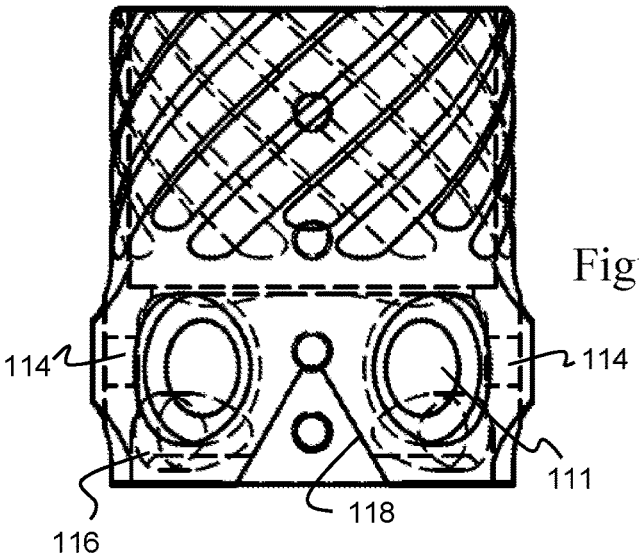
Figure 4C:
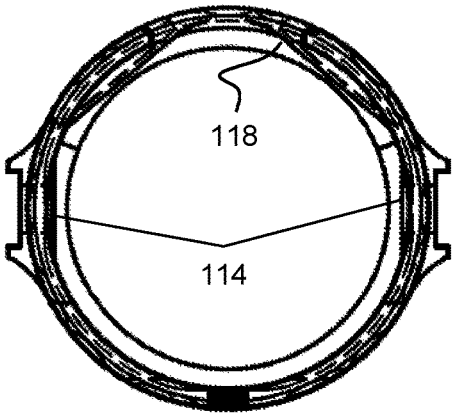
Figure 4D:
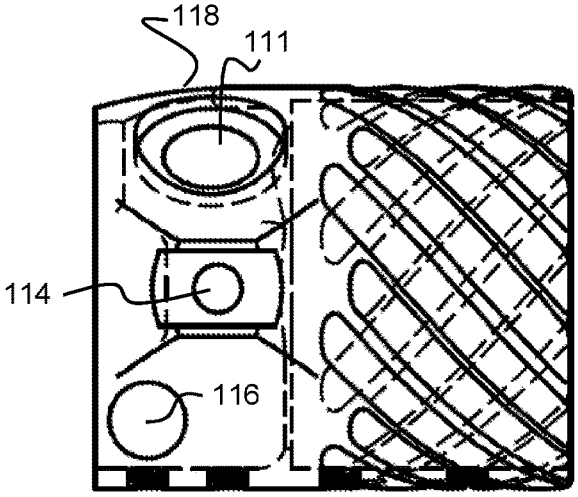

FIGS. 4A through 4D illustrate additional views of the optical scope body 100 illustrated in FIGS. 3A through 3F with dashed lines to indicate features not visible from each respective view. FIG. 4A is a rear or target side view, FIG. 4B is a top view from the same angle as illustrated in FIG. 3B, FIG. 4C is a front or aiming user view from the same angle as illustrated in FIG. 3F, and FIG. 4D is a right side view from the same angle as illustrated in FIG. 3C.

Figure 5A:
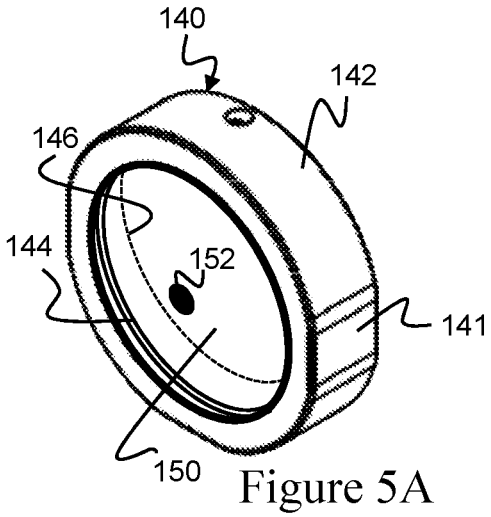
FIGS. 5A and 5B illustrate isometric views of example cartridge and lens assemblies according to aspects of the present invention.
Figure 5B:
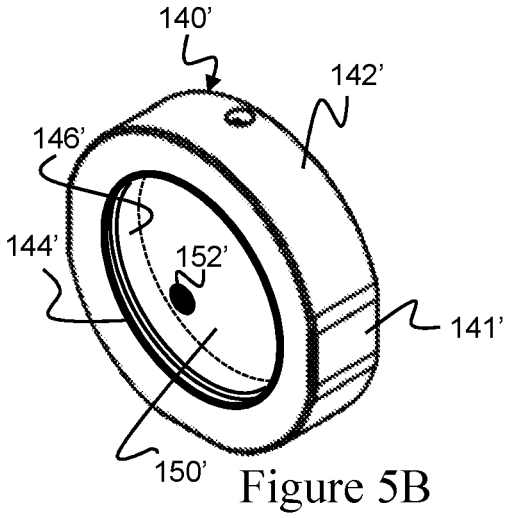

FIG. 5A illustrates an isometric view of the cartridge and lens assembly 140 illustrated in FIGS. 1B and 2. FIG. 5B illustrates an isometric view of an alternative embodiment of a cartridge and lens assembly 140' that can be used in place of the assembly 140 illustrated in FIG. 5A. The cartridge illustrated in FIG. 5B can house a smaller lens 150' compared to the lens 150 housed in the cartridge illustrated in FIG. 5A and can be secured within the bore of the scope body 110 by the same means as the cartridge illustrated in FIG. 5A. If a user desires to use a smaller diameter lens, the cartridge and lens assembly 140 illustrated in FIG. 5A can be removed from the bore of the scope body and replaced by the cartridge and lens assembly 140' illustrated in FIG. 5B.

The cartridge in FIG. 5A can be incompatible with the lens 150' in FIG. 5A and likewise, the cartridge in FIG. 5B can be incompatible with the lens 150 in FIG. 5A, meaning that a given cartridge is sized to hold a specific sized lens. Referring collectively to FIGS. 5A and 5B, either lens and cartridge assemblies 140, 140' can include an outer housing 142, 142', an inner housing 146, 146', an O-ring 144, 144', and a lens 150, 150' with an attached aiming point 152, 152'. Either outer housing 142, 142' can include one or more notches 141, 141' for a keyed fit within the scope body 110.

Figure 6:
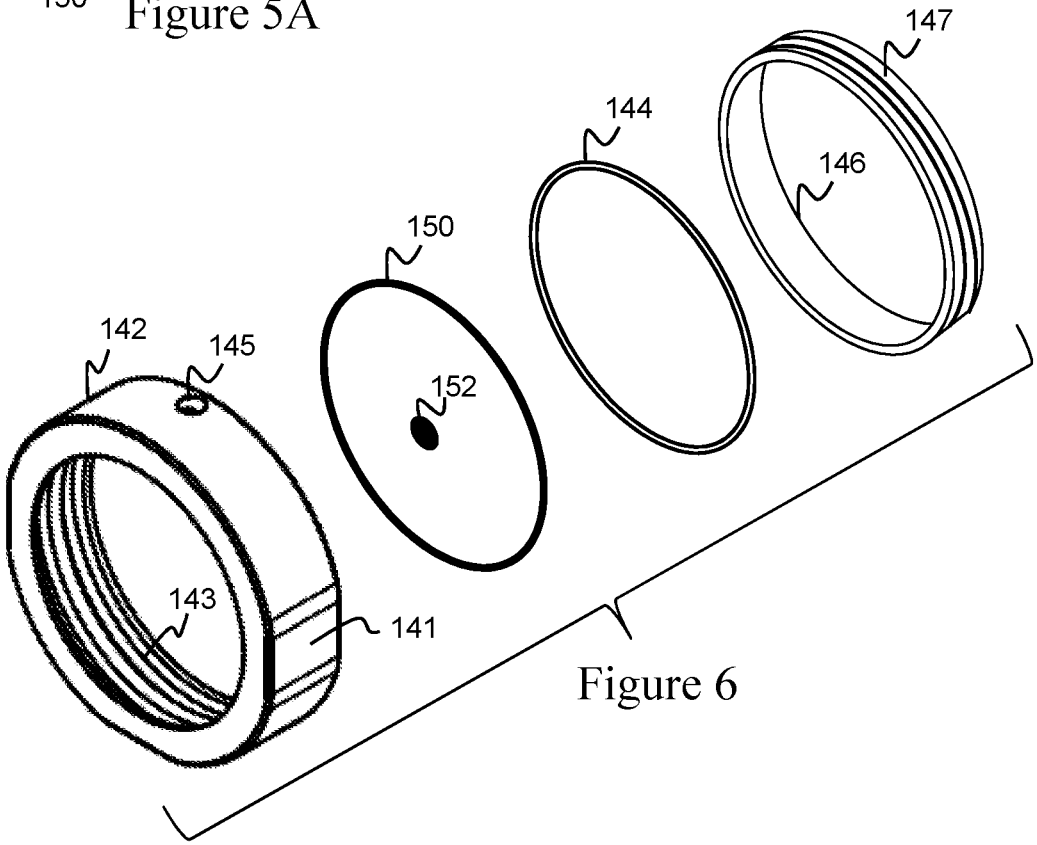
FIG. 6 illustrates an isometric exploded view of the example cartridge and lens assembly illustrated in FIG. 5A according to aspects of the present invention.

FIG. 6 is an exploded isometric view of components of the cartridge and lens assembly 140 illustrated in FIG. 5A. The outer housing 142 and the inner housing 146 can each be threaded 143, 147 so that the inner housing 146 screws into the outer housing 142. The O-ring 144 and the lens 150 can be sandwiched in between the inner housing 146 and the outer housing 142.

The aiming point 152 can be positioned at the center of the lens 150 and can fluoresce in response to be being illuminated with high energy wavelengths such as ultraviolet wavelengths and/or wavelengths of about 400 nm or less. The aiming point can be a spot, crosshairs, or other reticle shape. The aiming point can include a material that fluoresces when illuminated by a light source such as a pigmented fiber optic cable section, paint, sticker, etc. The pigmented fiber optic cable can be installed on the lens by drilling into the lens and affixing the fiber optic cable section in the drilled inlet or hole. The fluorescent paint can be applied to a surface of the lens in a dot shape or other reticle shape. The sticker including a fluorescent dot or other reticle shape can be applied to the lens. The aiming point can be positioned on the lens without the need for an up pin or other obstruction in the user's field of vision when aiming.

The lens and cartridge assembly 140' illustrated in FIG. 5B can be constructed in a similar fashion as described in FIG. 6. It is contemplated that additional cartridges can be constructed, each to accommodate a different, specific lens size, so that lenses of various sizes can be easily interchanged on a single scope.

FIGS. 7A through 7F illustrate various views of the lens cartridge of the cartridge and lens assembly 140 illustrated in FIGS. 1B, 2, 5A, and 6. The cartridge, including the outer housing 142, O-ring 144, and inner housing 146 is illustrated without a lens installed. FIG. 7A is an isometric view, FIG. 7B is a top view, FIG. 7C is a right side view, FIG. 7D is a bottom side view, FIG. 7E is a left side view, and FIG. 7F is a front or aiming user view. Notches 141 are illustrated on the right side in FIG. 7C, bottom in FIG. 7D, and left in FIG. 7E. The top illustrated in FIG. 7B can include a set screw divot 145 for installation in the scope body 110. Alternative cartridge constructions are contemplated including magnets and/or magnetic metal in the outer housing 142, 142' for magnetically attaching to the scope body, and alternative shapes and surfaces for providing a keyed fit with the scope body.

FIGS. 8A through 8F illustrate various views of the light pack illustrated in FIGS. 1A, 1B, and 2. FIG. 8A is an isometric view, FIG. 8B is a top view, FIG. 8C is a right side view, FIG. 8D is a bottom view, FIG. 8E is a left side view, and FIG. 8F is a front or aiming user view. FIG. 8D illustrates receptacles 128 sized to receive circular magnets or magnetic metal. The receptacles 128 can be positioned to align with magnets 112 on the scope body 110 as illustrated in FIG. 2. The scope body 110 can be tubular, and as illustrated in FIGS. 2, 8D, and 8F, the light pack 120 can have a conformal surface 121 shaped to conform to the outside of the tubular scope body 110.

FIGS. 8A-8C, 8E, and 8F illustrate a user interface 122 that is a knob that can be turned to adjust light output from the LED 126 illustrated in FIGS. 8D and 8F. The LED 126 can be mounted on an extension 124 illustrated in FIGS. 8A, 8D, and 8F sized to fit in a notch 118 in the scope body 110 illustrated in FIG. 2 so that the LED 126 can be positioned to illuminate within the bore of the scope body 110.

Figure 9A:
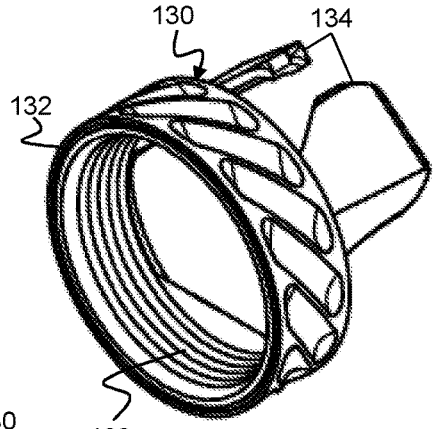
FIGS. 9A through 9F illustrate various views of an alignment ring according to aspects of the present invention.
Figure 9B:
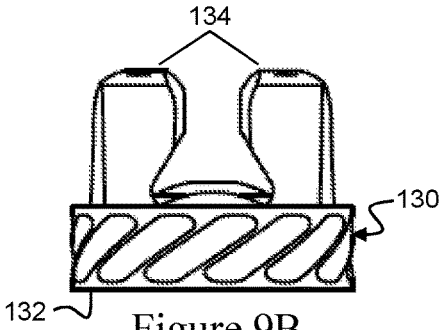
Figure 9E:
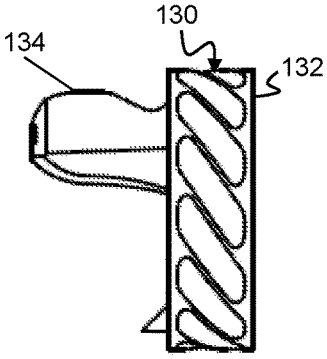
Figure 9F:
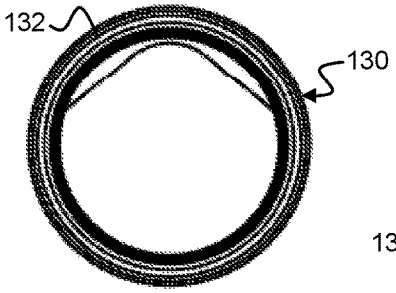
Figure 9C:
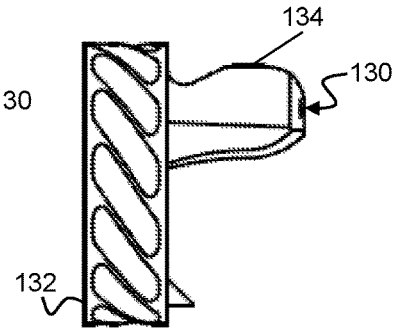
Figure 9D:
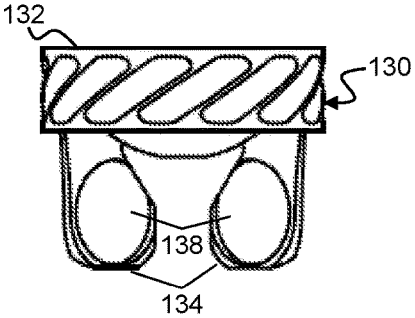

FIGS. 9A through 9F illustrate various views of the alignment ring 130 illustrated in FIGS. 1A, 1B, and 2. FIG. 9A is an isometric view, FIG. 9B is a top view, FIG. 9C is a right side view, FIG. 9D is a bottom view, FIG. 9E is a left side view, and FIG. 9F is a front or aiming user view. FIG. 9D illustrates receptacles 138 on the magnetic extensions 134. The receptacles 138 can be sized to receive circular magnets or magnetic metal and positioned to align with magnets 112 on the scope body 110 as illustrated in FIG. 2. The magnetic extensions 134 can be shaped to conform to a surface within the bore of the scope body 110.

The alignment ring 130 is an accessory that can be detached and attached to the scope body 110 by a user by pulling the extension tabs 134 out of the bore of the scope body 110 and sliding the extension tabs 134 into the bore of the scope body 110. The alignment ring 130 can include a high contrast surface 132 as illustrated in FIGS. 9A through 9F for aiding a user in aiming. The alignment ring 130 can include a light refracting surface 136 that can include ridges for reducing glare from reflections on the lens and/or within the scope bore.

Figure 10:
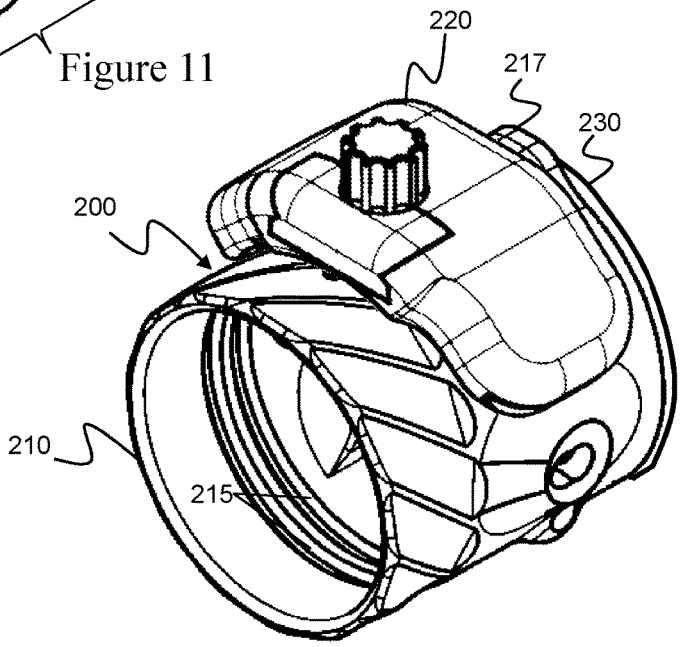
FIG. 10 illustrates an isometric view of another example optical sighting assembly according to aspects of the present invention.

FIG. 10 illustrates an isometric view of another embodiment of an optical sighting assembly 200. The optical sighting assembly 200 can include a scope body 210, a magnetic power pack 220, and an alignment ring 230. In the view illustrated in FIG. 10, while aiming, a user would view the optical sighting assembly from the side having the alignment ring 230, referred to herein as the front side.

Although not shown in FIG. 10, the optical sighting assembly 200 can include a lens with an attached aiming point like the lens 150 and aiming point 152 illustrated and described in relation to FIGS. 1B, 2, 5A, 5B, and 6. The scope body 210 can include two grooves 215 for receiving O-rings and the lens can be secured within the scope body 210 in between the grooves 215 by the O-rings. The scope body 210 can include access holes 213 for aiding in removing each O-ring form the grooves 215.

Figure 11:
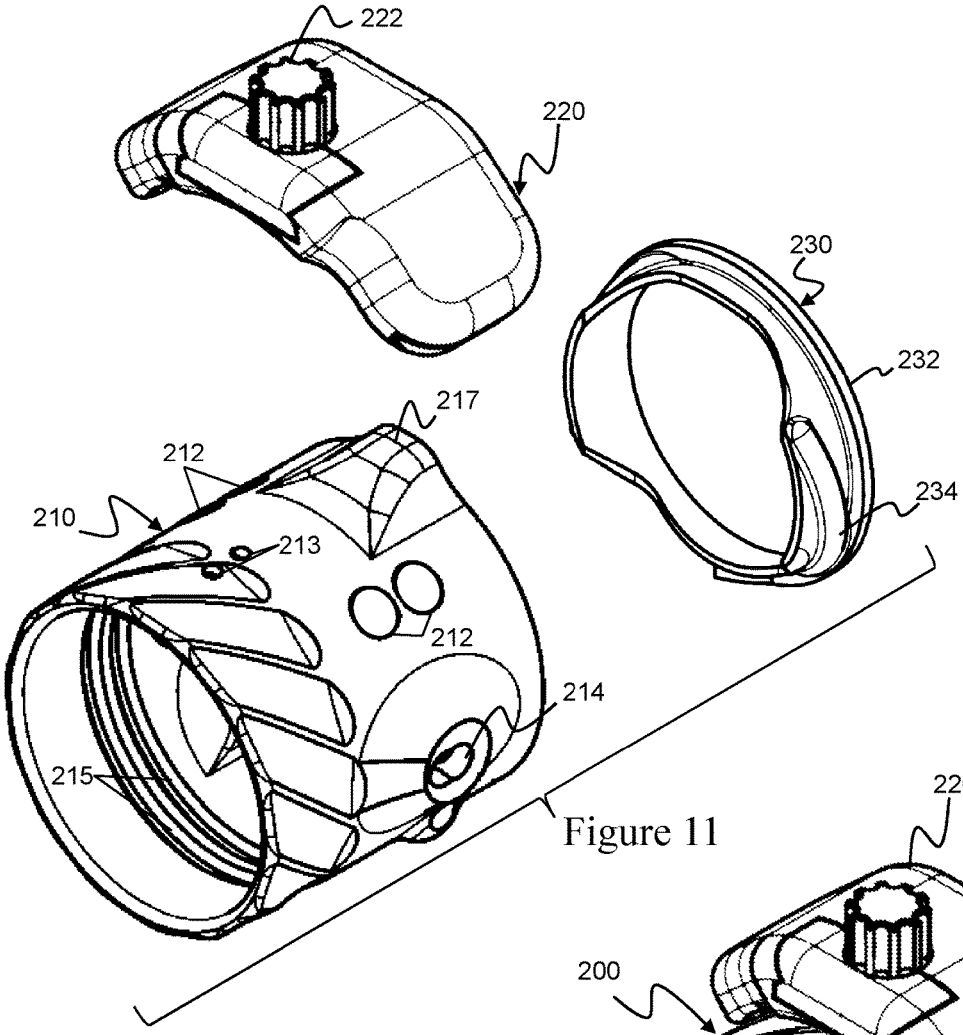
FIG. 11 illustrates an isometric exploded view of the example optical sighting assembly illustrated in FIG. 10 according to aspects of the present invention.

FIG. 11 illustrates an isometric exploded view of the example optical sighting assembly illustrated in FIG. 10. Referring collectively to FIGS. 10 and 11, the scope body 210 can include an integrated LED (not visible in the isometric views) positioned in a portion of the scope body housing 217 near the front or aiming user view side of the scope body. When a user is aiming, light from the LED can be directed away from a user and toward a lens installed between the grooves 215. The LED can be powered by the detachable power pack 220. The power pack 220 can house an energy source such as a battery or a capacitor and can include a user interface 222 that can be manipulated by a user to adjust light emitted from the LED.

The scope body 210 can include magnets 212 or magnetic metal for magnetically attaching the power pack 220. As illustrated in FIG. 11, four magnets 212 can be attached and/or integrated into the scope body 210. Two magnets in a pair can be longitudinally aligned and positioned near each other, the other two magnets of the four magnets 212 can form a second pair that are also longitudinally aligned with each other and positioned near each other, and the two pairs can be circumferentially aligned and equally spaced from the scope body portion 217 holding the LED. Alternative configurations are contemplated including using a single magnet in the scope body 210, using non-circular magnets, alternative placement of magnets on the scope body 210, using additional magnets, integrating magnets into each accessory 220 and using magnetic metal in place of the magnets 212 in the scope body 210, using customizable magnets with north and south poles patterned on a single side, etc.

The alignment ring 230 is an accessory that can be attached and detached from the scope body 210. The alignment ring 230 can include a high contrast surface 232 (e.g. brightly colored circle) that can be placed at the front or user aiming view of the scope body 210. The alignment ring 230 can aid the user in centering the scope in the user's field of vision when aiming. The alignment ring 230 can be attached to the scope body 210 with threads 234. Alternatively, the alignment ring 230 can be magnetically attached to the scope body 210 as described in relation to FIG. 2 and FIGS. 9A through 9D.

Figure 12B:
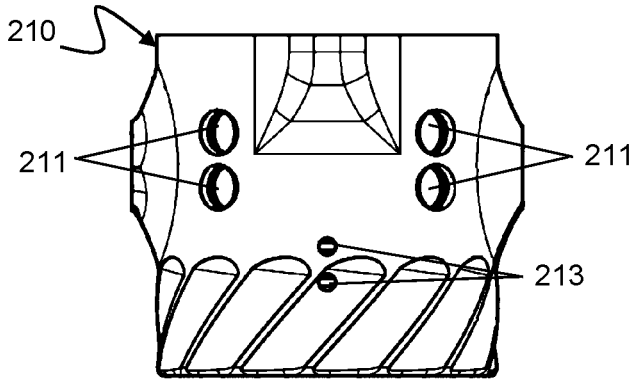
FIGS. 12A through 12D illustrate various views of an example optical scope body with integrated light source according to aspects of the present invention.
Figure 12A:
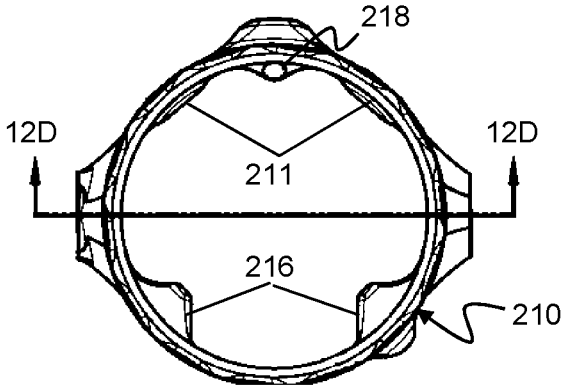
Figure 12C:
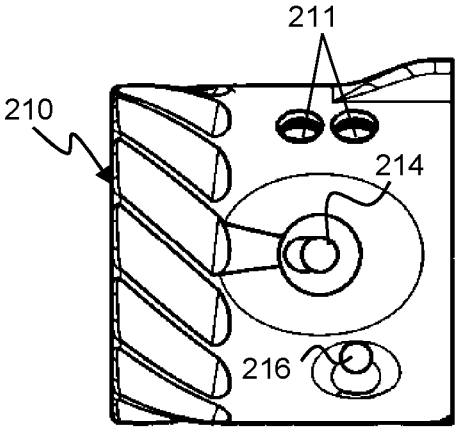
Figure 12D:
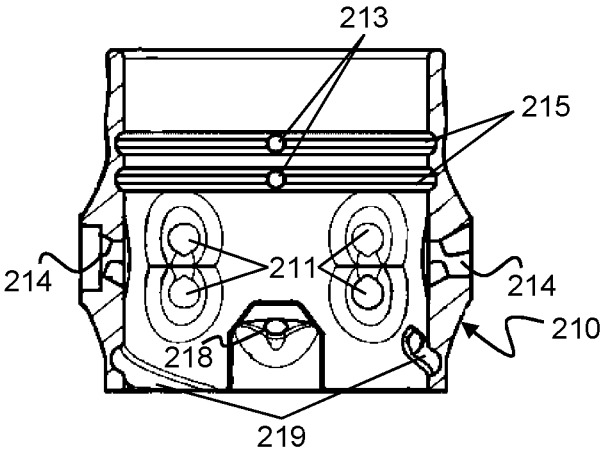

FIGS. 12A through 12D illustrate various views of the optical scope body with integrated light source illustrated in FIGS. 10 and 11. FIG. 12A is a rear or target side view, FIG. 12B is a top view, FIG. 12C is a left side view (left in relation to the view of a user while aiming), and FIG. 12D is a cross sectional view of the inside, upper portion of the scope body as indicated in FIG. 12A. The scope body 210 is illustrated in FIGS. 12A through 12D without magnets 212 so that receptacles 211 for the magnets 212 are visible.

The scope body 210 can include one or more sight mounting holes 214 for mounting the scope body 210 to a sight or other aiming device, one or more holes or inlets 216 for mounting a level, and threads 219 for receiving the alignment ring 230. The mounting holes 214 can be sized to receive a 10-32 threaded rod, washers, and nuts and other sight mounting hardware.

In FIG. 12D, the LED 218 is illustrated. The LED 218 can be permanently installed in the scope housing such that it is not designed for a user to remove or replace the LED 218. Receptacles 211 for magnets 212 can include fileted bumps. The grooves 215 and access holes 213 for installing and removing O-rings for holding the lens are illustrated in FIG. 12D.

Figure 13A:
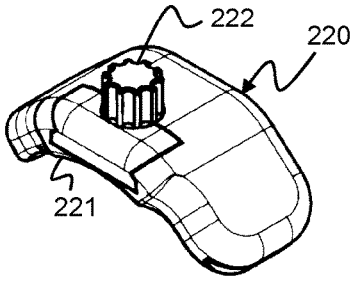
FIGS. 13A through 13E illustrate various views of an example power pack according to aspects of the present invention.
Figure 13B:
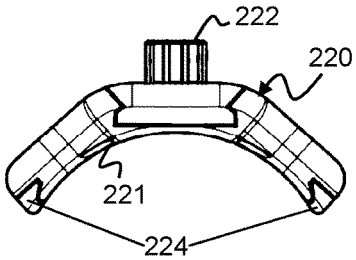
Figure 13C:
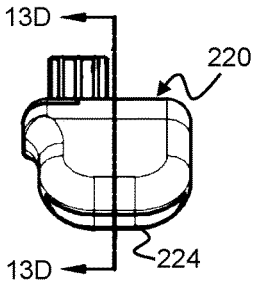
Figure 13D:
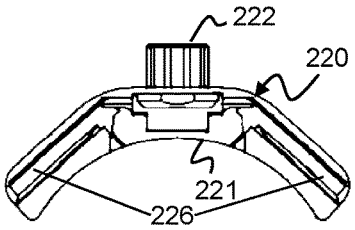
Figure 13E:
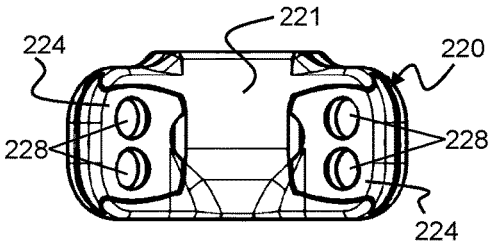

FIGS. 13A through 13E illustrate various views of the power pack 220 illustrated in FIGS. 10 and 11. FIG. 13A is an isometric view, FIG. 13B is a rear or target side view, FIG. 13C is a right side view (right in relation to the view of a user while aiming), FIG. 13D is a cross sectional view as indicated in FIG. 13C, and FIG. 13E is a bottom view. The power pack 220 can have cavities 226 for housing batteries or other energy sources as illustrated in FIG. 13D. The batteries can be replaceable and can be accessible by removing tabs 224 illustrated in FIGS. 13B and 13E. Cavities 226 can provide a snug fit and electrical contacts for a CR2032 lithium coin cell battery or similarly sized battery. When powering a UV LED, a power pack including two CR2032 lithium coin cell batteries can have a battery life of about 100 hours of continuous run time or more. Alternative power sources such as capacitors and rechargeable batteries are contemplated. Embodiments that include a charging port for a rechargeable capacitor or battery and associated protection and charging circuitry are contemplated. Embodiments that include circuitry for wireless inductive charging of a rechargeable capacitor or battery are contemplated. Embodiments that include circuitry for piezoelectric charging via vibration absorption of the bow are contemplated.

The power pack 220 can house magnets or magnetic metal in receptacles 228 illustrated in FIG. 13E. The receptacles 228 can be positioned to align the magnets or magnetic metal in the power pack 220 with the magnets 212 on the scope body 210 as illustrated in FIG. 11. As illustrated in FIGS. 10 through 12D, the scope body 210 can be substantially tubular with a protrusion 217 to house the LED 218 out of the line of view. As illustrated in FIGS. 10, 11, and 13A through 13E, the power pack 220 can have a conformal surface 221 shaped to conform to the curved outer surface of the scope body 210.

Magnets or magnetic metal disposed in the receptacles 228 of the power pack 220 can serve a dual purpose of forming a magnetic attachment to the scope body and providing an electrical connection from the energy source in the power pack 220 to the LED 218. Magnets in either the scope body 210 or the power pack 220 can be coated in a conductive metal. Embodiments are contemplated wherein only one of the scope body 210 or the power pack 220 include magnets coated in conductive metal, and the other of the scope body 210 or power pack 220 includes metallic metal. In such embodiments, the magnets can attach to the magnetic metal with a magnetic force and provide an electrical connection through a conductive coating on the magnets to the magnetic metal. Embodiments are contemplated wherein both the scope body and the power pack 220 include magnets coated in conductive material. In such embodiments, the magnets of the scope body 210 and the power pack 220 can attach to each other with a magnetic force and provide an electrically conductive path through contact of the electric coatings.

The user interface 222 can be a dial, a switch, a button, a slider, a wireless receiver or transceiver in communication with a remote-control device (e.g. user device), or other means for providing an input for controlling current output from the power pack 220 and thereby controlling light output from the LED 218. Embodiments are contemplated wherein a user can provide commands through an application on a mobile device, the mobile device can wirelessly transmit the commands to the wireless interface of the light pack 120, and the light output of the light pack 120 can be adjusted based on the commands.

The power pack 220 can include a rheostat that can be adjusted by the user interface 222 so that the user can adjust brightness of the LED. Brightness of the LED can be adjusted through a continuum or through a discrete number of brightness settings.

Alternative embodiments are contemplated wherein the power pack 220 lacks a user interface 220. In such embodiments, the LED 218 can be turned off by detaching the power pack 220 from the scope body 210 and turned on by attaching the power pack 220 to the scope body 210 to form a closed circuit between the energy source and the LED 218.

It is to be understood that the embodiments and claims disclosed herein are not limited in their application to the details of construction and arrangement of the components set forth in the description and illustrated in the drawings. Rather, the description and the drawings provide examples of the embodiments envisioned. The embodiments and claims disclosed herein are further capable of other embodiments and of being practiced and carried out in various ways. Also, it is to be understood that the phraseology and terminology employed herein are for the purposes of description and should not be regarded as limiting the claims.

Accordingly, those skilled in the art will appreciate that the conception upon which the application and claims are based may be readily utilized as a basis for the design of other structures, methods, and systems for carrying out the several purposes of the embodiments and claims presented in this application. It is important, therefore, that the claims be regarded as including such equivalent constructions.

Furthermore, the purpose of the foregoing Abstract is to enable the United States Patent and Trademark Office and the public generally, and especially including the practitioners in the art who are not familiar with patent and legal terms or phraseology, to determine quickly from a cursory inspection the nature and essence of the technical disclosure of the application. The Abstract is neither intended to define the claims of the application, nor is it intended to be limiting to the scope of the claims in any way. Instead, it is intended that the disclosed technology is defined by the claims appended hereto.

What is claimed is:

1. An optical sighting assembly comprising:
an optical scope body comprising a sighting bore; and
an accessory comprising a housing shaped to house an energy source, and configured to detachably attach to the optical scope body due at least in part to a magnetic force between the optical scope body and the accessory;
wherein the housing comprises a first magnet configured to provide at least a portion of the magnetic force to detachably attach the accessory to the optical scope body, and
wherein the first magnet comprises an electrically conductive coating configured to conduct an electric current from the energy source.

2. The optical sighting assembly of claim 1 further comprising:
a lens attached to the optical scope body;
a fluorescent aiming point attached to the lens; and
a light source attached to the optical scope body and positioned to illuminate the aiming point through a non-solid medium,
wherein the accessory comprises an energy source configured to provide an electrical current to the light source.

3. The optical sighting assembly of claim 2, wherein the light source is configured to illuminate the aiming point without obstructing a sight line of the optical sighting device.

4. The optical sighting assembly of claim 1, wherein the energy source comprises one or more of a lithium coin cell battery, a rechargeable battery, and a capacitor.

5. The optical sighting assembly of claim 1, wherein the accessory further comprises a user interface configured to be manipulated to adjust an electrical current supplied by the energy source.

6. The optical sighting assembly of claim 1,
wherein the optical scope body comprises a light source and a second magnet configured to provide at least a portion of the magnetic force to detachably attach the accessory to the optical scope body, and
wherein the second magnet comprises an electrically conductive coating, the coating configured to conduct an electrical current to the light source.

7. The optical sighting assembly of claim 1,
wherein the accessory further comprises a light source, and
wherein the light source is configured to receive an electrical current from the energy source.

8. The optical sighting assembly of claim 7 further comprising:
a lens attached to the optical scope body; and
a fluorescent aiming point attached to the lens,
wherein the light source is positioned in the accessory such that when the accessory is attached to the optical scope body, the light source is configured to illuminate the aiming point through a non-solid medium.

9. The optical sighting assembly of claim 1, wherein the accessory further comprises a lens cartridge comprising a keyed surface and a lens receptacle, wherein the keyed surface is configured to mate with the optical scope body in a predetermined orientation, and wherein the lens receptacle is configured to receive a lens.

10. The optical sighting assembly of claim 1, wherein the accessory further comprises an alignment ring, wherein the alignment ring comprises magnetic extensions, and wherein the magnetic extensions are configured to extend within the sighting bore of the optical scope body and provide at least a portion of the magnetic force between the optical scope body and the accessory.

11. An optical sighting assembly comprising:

an optical scope body comprising a sighting bore; and an accessory comprising a light source and configured to detachably attach to the optical scope body due at least in part to a magnetic force between the optical scope body and the accessory;

a lens attached to the optical scope body; and a fluorescent aiming point attached to the lens, wherein the light source is positioned in the accessory such that when the accessory is attached to the optical scope body, the light source is configured to illuminate the aiming point through a non-solid medium, and wherein the light source is configured to receive an electrical current from the energy source.

12. An optical sighting assembly comprising:

an optical scope body comprising a sighting bore; and an accessory comprising a lens cartridge and configured to detachably attach to the optical scope body due at least in part to a magnetic force between the optical scope body and the accessory;

wherein the lens cartridge comprises a keyed surface and a lens receptacle, wherein the keyed surface is configured to mate with the optical scope body in a predetermined orientation, and wherein the lens receptacle is configured to receive a lens.

13. An optical sighting assembly comprising:

an optical scope body comprising a sighting bore; and an accessory comprising an alignment ring and configured to detachably attach to the optical scope body due at least in part to a magnetic force between the optical scope body and the accessory;

wherein the alignment ring comprises magnetic extensions, and wherein the magnetic extensions are configured to extend within the sighting bore of the optical scope body and provide at least a portion of the magnetic force between the optical scope body and the accessory.

14. An optical sighting assembly comprising:

an optical scope body comprising a sighting bore; and a lens cartridge configured to be detachably installed in the sighting bore at a predetermined rotational orientation;

wherein the lens cartridge is sized to retain a first lens, wherein the lens cartridge is replaceable by a replacement lens cartridge configured to mate with the sighting bore, wherein the replacement lens cartridge is sized to retain a second lens, and wherein the lens cartridge is sized to be incompatible with the second lens and the replacement lens cartridge is sized to be incompatible with the first lens.

15. The optical sighting assembly of claim 14, wherein the lens cartridge comprises a keyed surface and a lens receptacle, and wherein the keyed surface is configured to mate with the sighting bore in the predetermined rotational orientation.

16. An optical sighting assembly comprising:

an optical scope body comprising a sighting bore;

a lens cartridge configured to be detachably installed in the sighting bore at a predetermined rotational orientation;

a lens retained within the lens cartridge;

a fluorescent aiming point attached to the lens;

a light source attached to the optical scope body and positioned to illuminate the aiming point through a non-solid medium when the lens cartridge is installed in the sighting bore; and an energy source attached to the optical scope body and configured to provide an electrical current to the light source.

17. The optical sighting assembly of claim 16, wherein the light source is configured to illuminate the aiming point without obstructing a sight line of the optical sighting device.

18. The optical sighting assembly of claim 16, wherein at least one of the light source and the energy source is magnetically attached to the optical scope body.

19. An optical sighting assembly comprising:

an optical scope body comprising a sighting bore;

a lens cartridge configured to be detachably installed in the sighting bore at a predetermined rotational orientation; and a light pack comprising an energy source and an LED, wherein the light pack is magnetically attachable to the optical scope body, wherein the light source is positioned to illuminate the sighting bore of the scope body when the light pack is attached to the optical scope body, and wherein the energy source is configured to provide an electrical current to the light source.

* * * * *